United States Patent [19]

Bacon

[11] Patent Number: 4,883,255

[45] Date of Patent: Nov. 28, 1989

[54] WINCH HANDLE

[75] Inventor: Walter H. Bacon, North Haven, Conn.

[73] Assignee: Custom products Corporation, North Haven, Conn.

[21] Appl. No.: 150,888

[22] Filed: Feb. 1, 1988

[51] Int. Cl.[4] ..... B25G 3/28; B66D 1/04

[52] U.S. Cl. ..... 254/266; 16/332; 81/177.1; 403/4; 403/328

[58] Field of Search ..... 254/217, 218, 219, 241, 254/243, 334, 342, 344, 345, 346, 347, 348, 349, 350, 351, 352, 353, 354, 355, 356, 357, 369, 381, DIG. 3, 266; 403/4, 328, 361; 81/177.1, 177.2, 177.85; 16/329, 332, 334, 344; 74/528, 529, 545, 548

[56] References Cited

U.S. PATENT DOCUMENTS

| | | | |
|---|---|---|---|
| 1,422,067 | 7/1922 | Abegg | 403/4 X |
| 1,592,574 | 7/1926 | Specht | 74/545 |
| 1,744,413 | 1/1930 | Peterson et al. | 81/177.1 |
| 2,210,742 | 8/1940 | Whitney | 81/177.1 X |
| 2,851,295 | 9/1958 | Chaffee | 81/177.85 X |
| 2,896,985 | 7/1959 | Braatz | 403/328 |
| 3,082,643 | 3/1963 | Grassi et al. | 403/328 X |
| 3,776,517 | 12/1973 | Davis et al. | 254/334 X |
| 4,211,388 | 7/1980 | Guangorena | 254/344 |
| 4,344,340 | 8/1982 | Erickson | 81/177.85 X |
| 4,631,989 | 12/1986 | Trowbridge et al | 81/177.85 X |
| 4,688,454 | 8/1987 | Scull | 81/119 |

FOREIGN PATENT DOCUMENTS

| | | | |
|---|---|---|---|
| 711033 | 6/1965 | Canada | 81/177.2 |

*Primary Examiner*—Joseph J. Hail, III

*Attorney, Agent, or Firm*—Robert H. Montgomery

[57] ABSTRACT

An operating handle for a winch having a four or eight-sided socket which comprises a hand engaging portion, a lever arm and a socket driver, the driver being of square shape and having a spring loaded detent therein arranged to extend outwardly of a side of the driver and engage a wall of a socket, the detent being positioned off-center of the vertical center line of the side of said driver and so positioned as to engage on a wall of an eight-sided socket.

3 Claims, 1 Drawing Sheet

WINCH HANDLE

FIELD OF THE INVENTION

This invention relates to winch handles and, more particularly, to the operating winch handles or winches as found on sailing vessels.

BACKGROUND OF THE INVENTION

Winches are commonly used on sailing vessels to set or trim a genoa or jib. Winches may also be used in other applications where it is desired to tension a sheet or halyard. The winches generally comprise a concave drum about which a rope, otherwise termed a sheet, is wound. The winch is utilized either to let out the sheet or to pull it, as the case may be, in accordance with the course being navigated and the direction of the wind. These winches comprise a socket member adapted to receive the driver of a winch handle. The socket members are of standard dimension across flats, usually 11/16th inches, and may be either defined by four sides or by eight sides.

It is not uncommon for the driver of the winch handle to slip out of the winch socket during operation. This necessitates an interruption or delay in the change of the angle of the sails and further necessitates reinsertion of the driver portion of the winch handle into the socket.

Accordingly, the present invention provides a new and improved winch handle with a winch socket engaging driver, which is accepted into either a four or eight-sided socket and includes detent means for retaining the winch handle driver into the socket so that inadvertent removal is difficult, but intended insertion or removal is easy.

SUMMARY OF THE INVENTION

Briefly stated, the invention, in one form thereof, comprises a winch handle having a hand engaging portion which is substantially parallel to rotational axis of the winch when the handle is in an operative position. The handle portion extends into a lever arm substantially perpendicular thereto, and the lever arm at the other end carries a driver head including a four-sided driver. The driver head has a socket defined therein, which receives a compressed biasing spring action on a detent element in the form of a ball which partially extends through the socket defined for the spring. The edges of the driver are lapped over to retain the detent element in the socket. The socket is positioned off center with respect to the vertical center line of the driver, so that it may engage a side of an eight-sided socket rather than to fall into an apex defined by the socket sides. This arrangement provides a locking of the driver in the winch socket, yet permits easy removal of the winch by straight vertical lifting of the winch handle to separate the driver from the socket.

An object of this invention is to provide a strong reliable handle for rotating marine winches using conventional production methods, including a means for retaining the handle in the winch socket, yet providing fast uncomplicated load and unload action.

A further object of this invention is to provide a winch handle design that does not require locking members between the driver and the winch socket which are awkward to operate.

The features of the invention which are believed to be novel are particularly pointed out and distinctly claimed in the concluding portion of the specification.

The invention, however, together with further objects and advantages thereof, may best be appreciated by reference to the following detailed description taken in conjunction with the drawings.

DETAILED DESCRIPTION OF THE PREFERRED EMBODIMENT OF THE INVENTION

Figures 1, 2, 3, 4, 5:
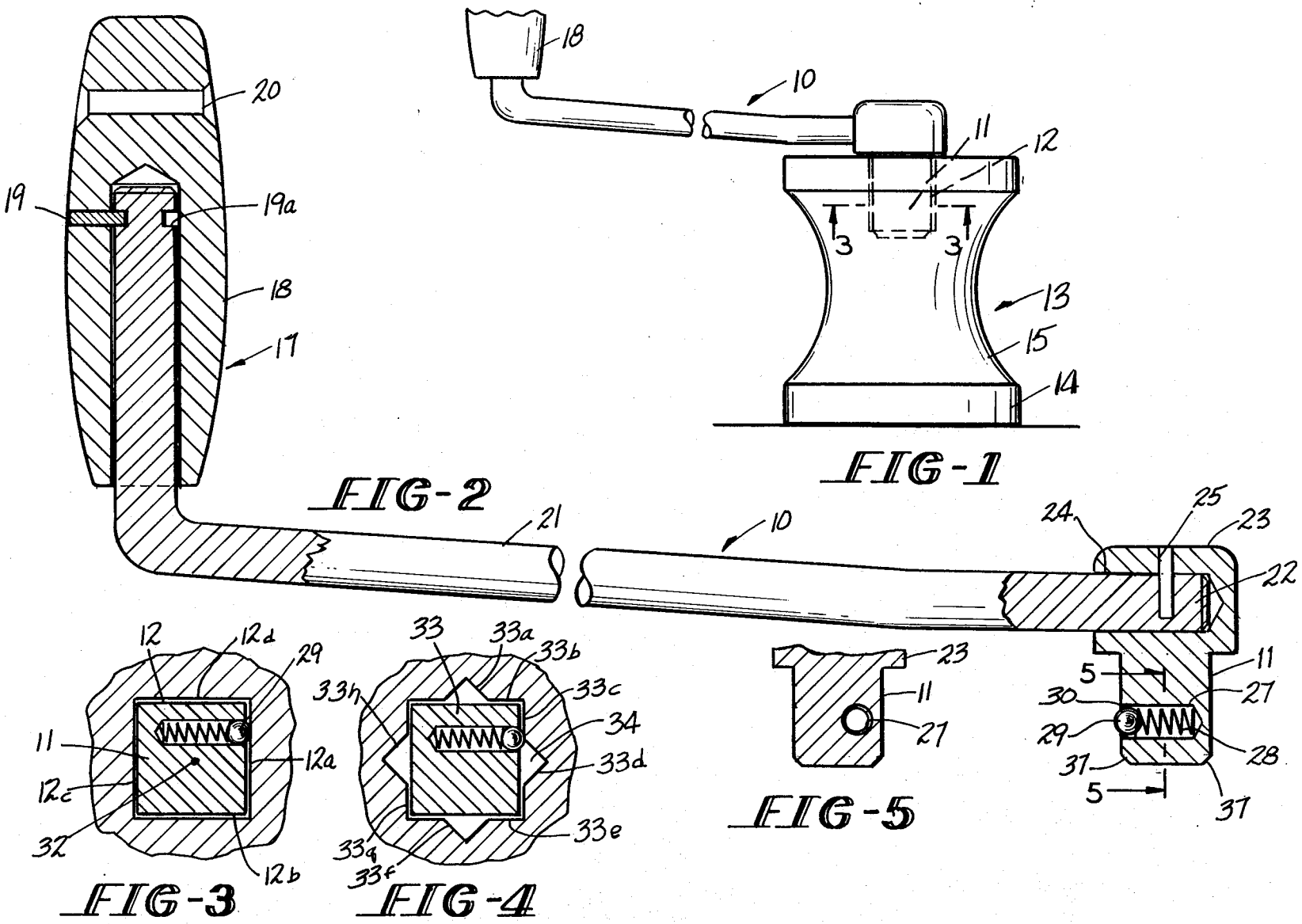
FIG. 1 is a side elevation depicting a sailboat winch with a winch handle joined thereto.
FIG. 2 is a side elevation partially in half-section of a winch handle embodying the invention.
FIG. 3 is a view seen in the plane of lines 3—3 of FIG. 1.
FIG. 4 is a view similar to FIG. 3, but showing the driver of the winch handle of FIG. 2 in an eight-sided winch socket.
FIG. 5 is a view seen in the plane of lines 5—5 of FIG. 2.

Reference is first made to FIG. 1 which shows the environment of the invention. A winch handle 10 having a driver portion 11 extends into a socket 12 of a winch 13. The winch 13, as simply shown, comprises a non-rotatable base portion 14 having a concave rotatable drum portion 15 which will receive a rope thereabout (not shown). The rope will be wound up as the drum portion 15 is turned.

FIG. 2 exemplifies a winch handle 10 embodying the invention. The winch handle 10 comprises an upright handle portion 17 having a hand gripping portion 18 received thereon. A pin 19 extends through portion 18 into an annular groove 19*a* to permit rotation of hand gripping portion 18 on handle portion 17. The hand engaging portion may also include an opening 20 therethrough for a lanyard. The handle portion 17 extends into a transverse or substantially parallel lever arm 21. Lever arm 21 at its other end 22 receives a driver head 23 which defines a socket 24 for receiving the end 22 of arm 21. The driver head may be secured as by means of pin 25 to end 22 of arm 21. The driver head includes driver portion 11 is a socket or bore 27 which receives therein a helical spring 28 which exerts an outward bias on a detent member 29 in the form of a ball. The ball 29 extends partially out of bore 27 and is retained therein by lapping over the edges 30 defining the opening to socket 27.

Reference is now made to FIG. 3 which exemplifies socket 12 having four sides 12*a*, 12*b*, 12*c*, and 12*d*. Socket 12 receives the driver 11 with little clearance therebetween. As may be seen in FIG. 3, the detent mechanism, including bore 27, is offset from the vertical center 32 of driver 11 and is in engagement with wall 12*a* of socket 12. This engagement of the detent element 29 with wall 12*a* will prevent inadvertent exit of driver 11 from socket 12. The extent of the offset of socket 27 from centerline 32 will now be explained with reference to FIG. 4.

FIG. 4 exemplifies driver 11 in an eight-sided socket 33, which is defined by walls 33*a*–*h*. As shown, the detent engages only one wall 33 of socket 34.

The definition of the eight-sided socket 33 amounts to the superimposition of two four-sided sockets, which are rotated forty-five degrees with respect to each other.

As will be seen by FIG. 4, the positioning of socket 27 and the detent mechanism therein is such that it will reside on a flat side wall shown as wall 33*c* of socket 33, and will not extend into an apex 34 defined by two adjacent walls, such as the walls 33*a* and 33*d*. The invention may also be embodied in an octagonal driver so long as the detent is positioned to engage a wall of the octagonal socket.

The bore 27 for the detent mechanism is preferably positioned in driver 11 such that the detent element is more than half of the distance from driver head 23 to the free end of driver 11, so as to provide greater locking engagement or retention, that is, vertical torque on the lever arm 21 will not tend to pull the driver portion 11 out of the socket.

This construction prevents inadvertent removal of the winch handle from a winch socket when the winch is being cranked, yet permits easy entrance of the driver into a winch socket and easy removal thereof by straight vertical movement.

To enhance entrance of the driver 11 into socket 12 or 33, the bottom corners of driver 26 are chamfered as shown in 37 in FIG. 2.

It may thus be seen that the objects of the invention set forth, as well as those made apparent from the foregoing description, are efficiently attained. While a preferred embodiment of the invention has been set forth for purposes of disclosure, modifications to the disclosed embodiment of the invention, as well as other embodiments thereof, may occur to those skilled in the art. Accordingly, the appended claims are intended to cover all embodiments of the invention and modifications to the disclosed embodiment which do not depart form the spirit and scope of the invention.

Having thus described the invention, what is claimed is:

1. An operating handle for a winch having a four or eight-sided socket comprising a hand engaging portion, a lever arm and a driver, said driver being secured to an end of said lever arm at an end opposite to said hand engaging portion, said driver having a square shape and having a bore in one side thereof, a detent in said bore, a spring in said bore urging said detent outwardly of a side of said driver to engage a wall of a socket, said bore being positioned off the vertical center line of said side of said driver and so positioned that said detent will engage only one wall of an eight-sided socket.

2. The operating handle of claim 1 where the leading edges of said driver are chamfered to facilitate entrance of said driver into a socket.

3. The operating handle of claim 1 where said driver has a head connected to said lever arm and said driver extends from said head to a free end, said bore being defined in said driver a distance from said head such that said detent extends from said bore at a distance from said head which is over one-half of the distance from said head to said free end of said driver.

* * * * *